US005683552A

United States Patent [19]

Suey

[11] Patent Number: 5,683,552

[45] Date of Patent: Nov. 4, 1997

[54] COKE OVEN DOOR LINER ASSEMBLY

[76] Inventor: Paul V. Suey, R.D. 1, Ridge Rd., Sugar Loaf Hill, Natrona Heights, Pa. 15065

[21] Appl. No.: 650,156

[22] Filed: May 20, 1996

[51] Int. Cl.[6] ..... C10B 25/06

[52] U.S. Cl. ..... 202/248; 110/173 R; 202/269

[58] Field of Search ..... 202/248, 269, 202/268, 267.1; 110/173 R

[56] References Cited

U.S. PATENT DOCUMENTS

| | | | |
|---|---|---|---|
| 2,993,845 | 7/1961 | Coe | 202/248 |
| 4,118,284 | 10/1978 | Bowman et al. | 202/248 |
| 4,197,163 | 4/1980 | Aikman | 202/248 |
| 4,216,061 | 8/1980 | Blase | 202/248 |
| 4,217,177 | 8/1980 | Gerding et al. | 202/248 |
| 4,381,972 | 5/1983 | Stog | 202/248 |
| 4,414,072 | 11/1983 | Breidenbach et al. | 202/248 |
| 4,744,867 | 5/1988 | Suey | 202/248 |
| 4,793,900 | 12/1988 | Suey | 202/248 |
| 4,917,772 | 4/1990 | Koschlig et al. | 202/248 |
| 5,395,485 | 3/1995 | Nashan et al. | 202/248 |

FOREIGN PATENT DOCUMENTS

| | | |
|---|---|---|
| 0 154 232 | 9/1985 | European Pat. Off. . |
| 3528512 | 5/1986 | Germany . |

*Primary Examiner*—Scott Kastler

*Attorney, Agent, or Firm*—Armstrong, Westerman, Hattori, McLeland & Naughton

[57] ABSTRACT

A coke oven door assembly has first abutting vertically aligned refractory cold face layers, second abutting vertically aligned refractory hot face layers spaced therefrom, and an integral one piece uppermost refractory section having a bottom, a horizontally extending top portion, and first and second downwardly depending leg portions with an interconnecting web. The interconnecting web is spaced from the side walls of the uppermost refractory section between the leg portions and extends from the horizontally extending portion at least partially downwardly towards the bottom of the uppermost refractory section.

14 Claims, 3 Drawing Sheets

COKE OVEN DOOR LINER ASSEMBLY

BACKGROUND OF THE INVENTION

The present invention relates to a coke oven door liner assembly used to seal an opening in a coke oven.

In my earlier patents, U.S. Pat. No. 4,744,867 and U.S. Pat. No. 4,793,900, the contents of both patents being incorporated by reference herein, there are described coke oven door assemblies and liners which provide for the passage of gases between a cold face refractory liner and a hot face refractory liner such that condensation would not occur between the spaced liners. In U.S. Pat. No. 4,744,867 the coke oven door liner described had a first refractory liner, a cold face liner, which was attached to the coke over door and a spaced second refractory liner, a hot face liner, attached to the first refractory liner. The attachment of the two liners was carried out in a manner that allows for gases created from roasting coal in the coke oven to enter a chamber provided by the spaced liners, which gases rise to the top portion of the coke oven for removal from the oven. As described therein, in order to prevent coal being raked at the pusher side of the oven from falling into the chamber between the two liners, it was suggested that the topmost vertical section of the hot face refractory liner be L-shaped and have an extension which projected from the hot face liner to the cold face liner so as to cover the top of the elongated chamber between the two liners. A similar arrangement was described in U.S. Pat. No. 4,793,900 where, in addition to the presence of ceramic wiper strips, at the sides of the hot face refractory liner, and sole plates, an extension was suggested on the topmost refractory section of the hot face refractory liner which extended towards the cold face refractory liner so as to prevent coal or coke from entering the spacing between the two refractory liners.

While the use of an extension on the hot face refractory liner which extends to the cold face refractory liner successfully prevented coal or coke from entering the chamber between those two refractory liners, a problem would sometimes arise when the coke oven operator did not fill the coke oven to full capacity. Since connecting means, such as Z-shaped metal bars, were used to secure the top cold face refractory section to the top hot face refractory section, when the coke oven was changed to a level below the upper Z-shaped metal bars, high temperature gases, up to about 2500° F. (1535° C.) affected the integrity of the metal bars, even when the same were composed of a high temperature resistant stainless steel. Warping or other damage to the metal connectors would thus cause problems relative to the stability of the top refractory liner sections.

It is an object of the present invention to provide a coke oven door assembly having hot face refractory sections and spaced cold face refractory sections where the need for metal connectors therebetween is avoided at the top area of the refractory sections.

SUMMARY OF THE INVENTION

A coke oven door assembly for sealing an opening in a coke oven has a plurality of first abutting vertically aligned refractory layers which act as a cold face refractory liner and are adapted for securement to the inner surface of a coke oven door, and a plurality of second abutting vertically aligned refractory layers spaced from and secured to the cold face refractory liner which act as a hot face refractory liner, and an integral one piece uppermost refractory section. The uppermost refractory section has a bottom, a horizontally extending top portion, and first and second downwardly depending leg portions with an interconnecting web. The first downwardly depending leg portion is adapted for securement to the coke oven door in vertical alignment with the cold face refractory liner and extends to the bottom of the uppermost refractory section, while the second downwardly depending leg portion is adapted for vertical alignment with the hot face refractory liner. The second downwardly depending leg portion may extend to the bottom of the uppermost refractory section or the same may be shorter than the first downwardly depending leg portion with a leg segment provided extending from the shorter second downwardly depending leg portion to the level of the bottom wall of said uppermost refractory section.

The interconnecting web is spaced from the side walls of the uppermost refractory section, between the first and second downwardly depending leg portions and extends from the horizontally extending portion at least partially downwardly towards the bottom of the uppermost refractory section.

With this arrangement, gases that flow upwardly between the hot face and cold face refractory liners will continue to flow at least partially along the sides of the interconnecting web of the uppermost refractory section and rise to the top of the coke oven for removal from the oven.

BRIEF DESCRIPTION OF THE DRAWINGS

The invention will be more fully understood by reference to the accompanying drawings which illustrate embodiments of the present coke oven door assembly, and wherein.

DETAILED DESCRIPTION

Figure 1:
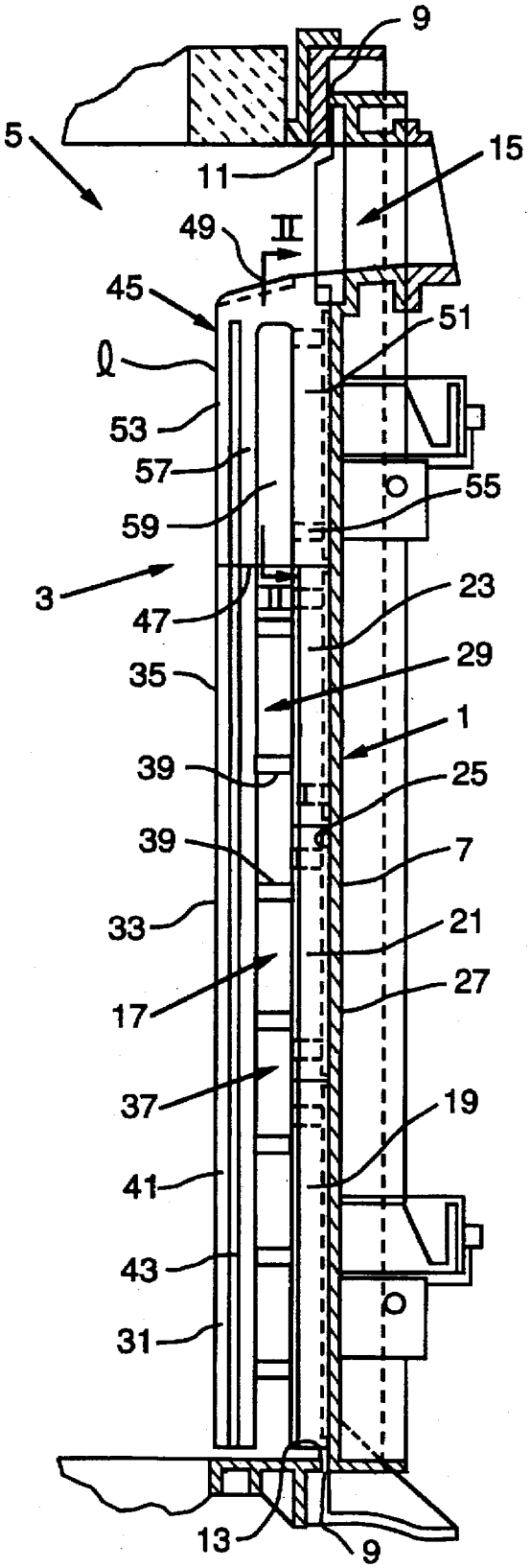
FIG. 1 is a vertical section through a portion of a coke oven showing an embodiment of the coke oven door assembly on a coke oven door in sealing position.
Figure 4:
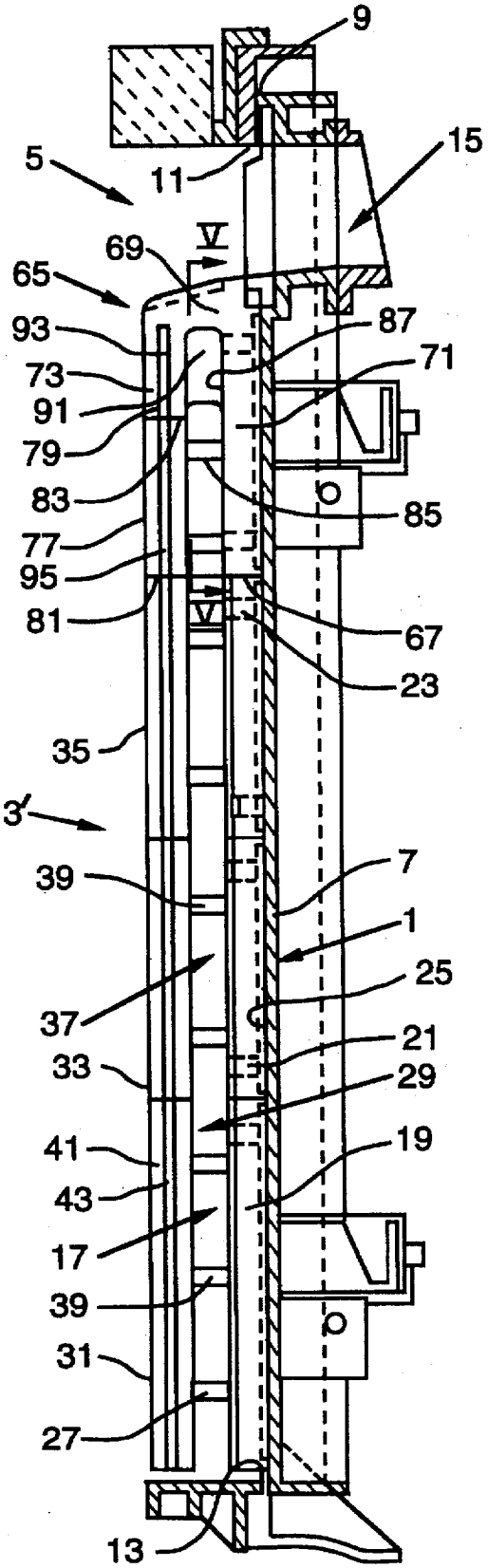
FIG. 4 is a vertical section through a portion of a coke oven showing another embodiment of the coke oven door assembly on a coke oven door in sealing position.

Referring now to the drawings, FIGS. 1 and 4 illustrate different embodiments of the coke oven door assembly of the present invention sealing the pusher side of a coke oven opening. The invention is also applicable for use at the coke side of a coke oven opening.

In FIG. 1, a coke oven cast metal outer door 1 has a door assembly 3 which is provided to insulate the outer door 1 and decrease heat loss from the coke oven chamber 5 when coal is being coked. The metal outer door 1 includes a door panel 7 with seals 9 which engage upper and lower sealing plates 11 and 13. An opening 15 is provided in the metal outer door 1 for a leveller (not shown) to be inserted into the coke oven chamber 5 to level coal that has been charged to the coke oven. A cold face refractory liner 17 is shown which comprises a plurality of first abutting vertically aligned refractory sections 19, 21 and 23 which are adapted for securement to the inner surface 25 of the coke oven door panel 7, such as by bolts 27 embedded in the refractory sections. A hot face refractory liner 29 is also provided which comprises a plurality of second abutting vertically aligned refractory sections 31, 33 and 35 which are spaced from the cold side refractory liner 17 to form a chamber 37 therebetween. The second abutting vertically aligned refractory sections 31, 33 and 35 are secured to the first abutting vertically aligned refractory sections 19, 21 and 23 by bars 39, such as the Z-shaped bars described in U.S. Pat. No. 4,744,867 and U.S. Pat. No. 4,793,900. Preferably, the side walls 41 of the second abutting vertically aligned refractory sections 31, 33 and 35 have a groove 43 vertically formed thereon for placement of wiper strips as described in U.S. Pat. No. 4,793,900.

Figure 2:
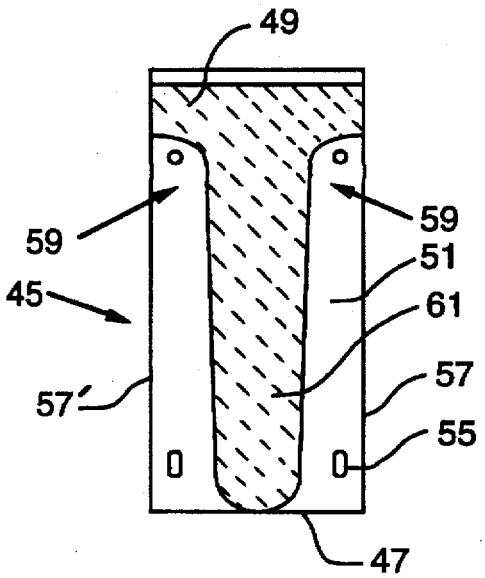
FIG. 2 is a cross-sectional view taken along lines II—II of FIG. 1.
Figure 3:
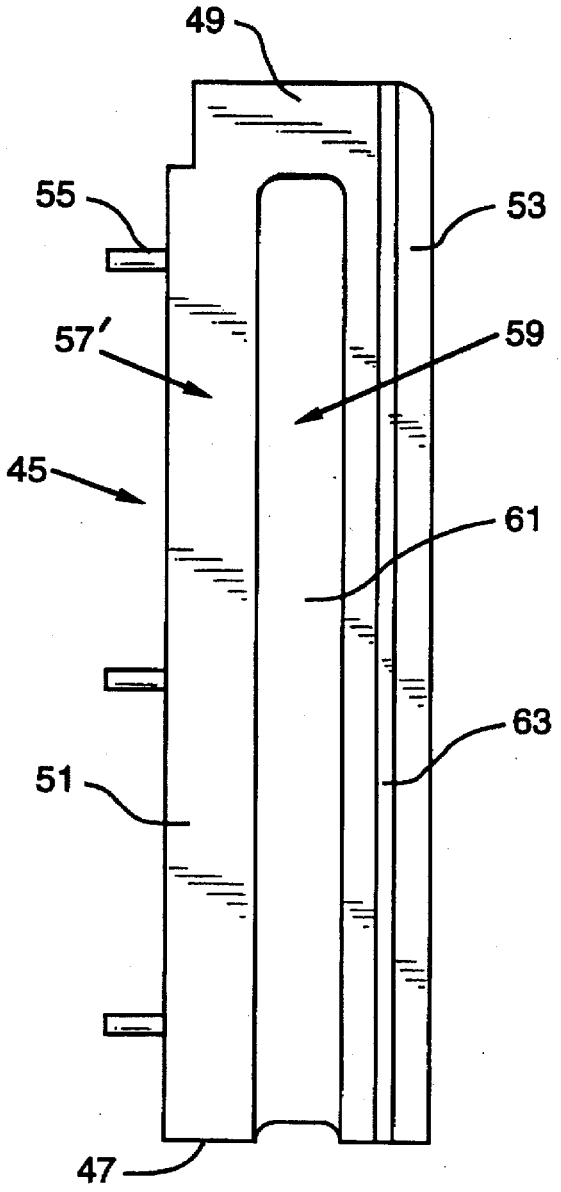
FIG. 3 is an enlarged side elevational view of the uppermost refractory section, rotated 180°, of the coke oven door assembly illustrated in FIG. 1.

An uppermost refractory section 45 is provided according to the present invention which is formed as an integral one piece unit. The uppermost refractory section 45 has a bottom 47, a horizontally extending top portion 49, a first downwardly depending leg portion 51 and a spaced second downwardly depending leg portion 53. The first downwardly depending leg portion 51 is adapted for securement to the coke oven door inner surface 25, such as by bolts 55, in vertical alignment with and preferably abutting the cold face refractory liner 17, and extends from the horizontally extending top portion 49 to the bottom 47 of the uppermost refractory section 45. The second downwardly depending leg portion 53 is spaced from the first downwardly depending leg portion 51 and also extends from the horizontally extending top portion 49 to the bottom 47 of the uppermost refractory section 45, and is adapted for vertical alignment with and preferably abutting the hot face refractory liner 29. The side walls 57, 57$^1$ of the uppermost refractory section 45 each preferably have a groove 59 therein so as to form an interconnecting web 61 between the side walls 57, 57$^1$ that is spaced therefrom. In the embodiment illustrated in FIGS. 1–3, the interconnecting web 61 extends from the horizontally extending top portion 49 to the bottom 47 of the uppermost refractory section 45. Channels 63 may be formed in the side walls 57 and 57$^1$ vertically along the second downwardly depending leg portion for securement therein of ceramic wiper strips, such as those shown in the coke oven door liner hot face refractory liner of U.S. Pat. No. 4,793,900.

With the use of the coke oven door assembly of the present invention, should the operator of the coke oven fill the coke oven to a level below the top of the hot face refractory liner 29, such as only to the level 1 illustrated in FIG. 1, there are no metal connectors between the first and downwardly depending leg portions 51 and 53 of the uppermost refractory section 45 that would be affected by high heat levels that may result above that level. However, with the grooves 59 forming the interconnecting web 61 present in the uppermost refractory section 45, hot gases travelling up through the chamber 37 between the hot and cold face refractory liners 29 and 17 will continue to flow upwardly along the side of the interconnecting web and then outwardly so as to be able to rise to the top of the coke oven for removal.

Figure 6:
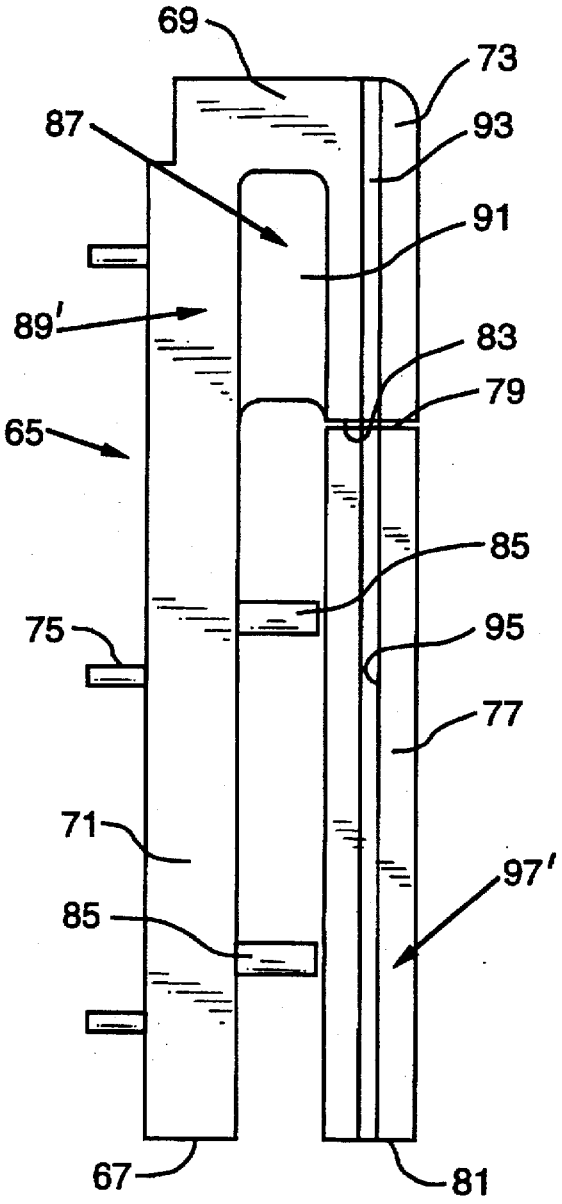
FIG. 6 is an enlarged side elevational view of the uppermost refractory section, rotated 180°, of the coke oven door assembly illustrated in FIG. 4.
Figure 5:
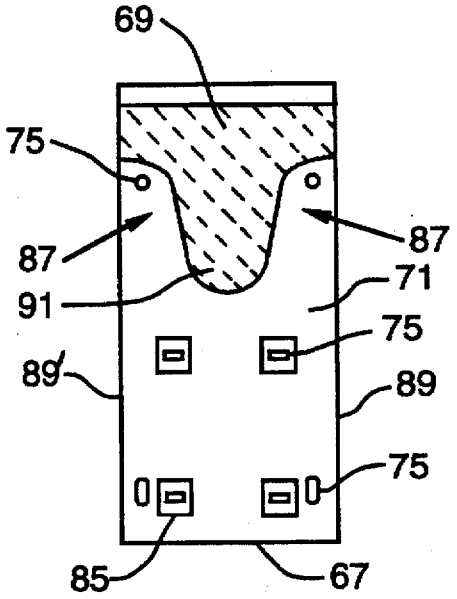
FIG. 5 is a cross-sectional view taken along lines V—V of FIG. 4.

In FIGS. 4–6, another embodiment of the coke oven door assembly is illustrated. The coke oven door assembly 3$^1$ has the components of coke oven door assembly 3 and like reference numerals are used, except that the uppermost refractory section 65 is of a different structure. As shown, the uppermost refractory section 65 is formed as an integral one piece unit having a bottom 67, a horizontally extending top portion 69, a first downwardly depending leg portion 71 and a spaced second downwardly depending leg portion 73. The first downwardly depending leg portion 71 is adapted for securement to the coke oven door inner surface 25, such as by bolts 75, in vertical alignment with and abutting the cold face refractory liner 17, and extends from the horizontally extending top portion 69 to the bottom 67 of the uppermost refractory section 65. The second downwardly depending leg portion 73 is spaced from the first downwardly depending leg portion 71 and is shorter than the first downwardly depending leg portion 71 and is adapted for alignment with the hot face refractory liner 29 but spaced therefrom. A leg segment 77 is provided which has a top wall 79 and bottom wall 81. The top wall 79 is closely adjacent to or may abut the terminus 83 of the second downwardly depending leg portion 73 and the bottom wall 81 is at the level of the bottom 67 of the uppermost refractory section 65. The leg segment 77 is secured, in spaced relationship, to the first downwardly depending leg portion 71 by connectors 85, such as the Z-shaped bars described in my previous patents referenced herein, and is adapted for vertical alignment with and preferably abutting the hot face refractory liner 29. In the embodiment of FIGS. 4–6, a groove 87 is formed in each of the side walls 89, 89$^1$ of the upper refractory section 65 to form an interconnecting web 91 that is spaced therefrom. The interconnecting web 91 extends from the horizontally extending top portion 69 to the terminus 83 of the second downwardly depending leg portion 73. Channels 93 may be formed in the side walls 89, 89$^1$ of the downwardly depending second leg portion 73 and channels 95 may be formed in the side walls 97, 97$^1$ of the leg segment 77 for securement therein of ceramic wiper strips.

This second embodiment will operate in the same manner as the first embodiment described where the level of the coke in the coke oven is above the terminus 83 of the second downwardly depending leg portion 73.

What is claimed is:

1. In a coke oven door assembly for sealing a coke oven, having a cold face refractory liner adapted for securement to an inner surface of a coke oven door, for sealing a coke oven opening, and a hot face refractory liner spaced from and secured to said cold face refractory liner, the improvement comprising:

an uppermost refractory section formed as an integral one piece unit having a bottom, a horizontally extending top portion, a first downwardly depending leg portion adapted for securement to said coke oven door in vertical alignment with said cold face refractory liner, and a second downwardly depending leg portion adapted for vertical alignment with said hot face refractory liner, said uppermost refractory section having side walls and an interconnecting web spaced from said side walls between said first and second downwardly depending leg portions, extending from said horizontally extending portion at least partially downwardly to said bottom, so as to enable gases flowing upwardly between said spaced hot face and cold face refractory liners to continue flow at least partially along sides of said interconnecting web of said uppermost refractory section and rise to the top portion of said oven for removal therefrom.

2. A coke oven door assembly for sealing a coke oven as defined in claim 1 wherein said cold face refractory liner is formed from a plurality of first abutting vertically aligned refractory layers.

3. A coke oven door assembly for sealing a coke oven as defined in claim 2 wherein said hot face refractory liner is formed from a plurality of second abutting vertically aligned refractory layers.

4. A coke oven door assembly for sealing a coke oven as defined in claim 1 wherein said interconnecting web extends vertically along only a minor portion of said uppermost refractory section.

5. A coke oven door assembly for sealing a coke oven as defined in claim 1 wherein said interconnecting web extends to the bottom of said uppermost refractory section.

6. A coke oven door assembly for sealing a coke oven as defined in claim 1 wherein said first downwardly depending leg portion has a bottom wall, said second downwardly depending leg portion is shorter than said first downwardly depending leg portion, and a leg segment is provided extending from said second downwardly depending leg portion to the level of the bottom of said uppermost refractory section.

7. A coke oven door assembly for sealing a coke oven as defined in claim 6 wherein said interconnecting web extends to the level of the bottom wall of said second downwardly depending leg portion.

8. In a coke oven door assembly for sealing a coke oven, having a cold face refractory liner, formed from a plurality of first abutting vertically aligned refractory layers, adapted for securement to an inner surface of a coke oven door, for sealing a coke oven opening, and a hot face refractory liner, formed from a plurality of second abutting vertically aligned refractory layers, spaced from and secured to said cold face refractory liner, the improvement comprising:

an uppermost refractory section formed as an integral one piece unit having a bottom, a horizontally extending top portion, a first downwardly depending leg portion adapted for securement to said coke oven door in vertical alignment with said cold face refractory liner, and a second downwardly depending leg portion adapted for vertical alignment with said hot face refractory liner, said uppermost refractory section having side walls and an interconnecting web spaced from said side walls between said first and second downwardly depending leg portions, extending from said horizontally extending portion downwardly to said bottom, so as to enable gases flowing upwardly between said spaced hot face and cold face refractory liners to continue flow at least partially along sides of said interconnecting web of said uppermost refractory section and rise to the top portion of said oven for removal therefrom.

9. In a coke oven door assembly for sealing a coke oven, having a cold face refractory liner, formed from a plurality of first abutting vertically aligned refractory layers, adapted for securement to an inner surface of a coke oven door, for sealing a coke oven opening, and a hot face refractory liner, formed from a plurality of second abutting vertically aligned refractory layers, spaced from and secured to said cold face refractory liner, the improvement comprising:

an uppermost refractory section formed as an integral one piece unit having a bottom, a horizontally extending top portion, a first downwardly depending leg portion having a bottom wall and adapted for securement to said coke oven door in vertical alignment with said cold face refractory liner, and a second downwardly depending leg portion adapted for vertical alignment with said hot face refractory liner, said second downwardly depending leg portion being shorter than .said first downwardly depending leg portion, and a leg segment extending from said second downwardly depending leg portion to the level of the bottom of the uppermost refraction section, said uppermost refractory section having side walls and an interconnecting web spaced from said side walls between said first and second downwardly depending leg portions, extending from said horizontally extending portion to the bottom wall of said second downwardly depending leg portion, so as to enable gases flowing upwardly between said spaced hot face and cold face refractory liners to continue flow at least partially along sides of said interconnecting web of said uppermost refractory section and rise to the top portion of said oven for removal therefrom.

10. A coke oven door for sealing a coke oven wherein said coke oven door has:

a metallic door panel having an inner surface;

a cold face refractory liner secured to the inner surface of said metallic door panel;

a hot face refractory liner spaced from and secured to said cold face refractory liner; and an uppermost refractory section formed as an integral one piece unit having a bottom, a horizontally extending top portion, a first downwardly depending leg portion secured to said coke oven door in vertical alignment with said cold face refractory liner, and a second downwardly depending leg portion in vertical alignment with said hot face refractory liner, said uppermost refractory section having side walls and an interconnecting web spaced from said side walls between said first and second downwardly depending leg portions, extending from said horizontally extending portion at least partially downwardly to said bottom, so as to enable gases flowing upwardly between said spaced hot face and cold face refractory liners to continue flow at least partially along sides of said interconnecting web of said uppermost refractory section and rise to the top portion of said oven for removal therefrom.

11. A coke oven door for sealing a coke oven as defined in claim 10 wherein said cold face refractory liner is formed from a plurality of first abutting vertically aligned refractory layers.

12. A coke oven door for sealing a coke oven as defined in claim 11 wherein said hot face refractory liner is formed from a plurality of second abutting vertically aligned refractory layers.

13. A coke oven door for sealing a coke oven as defined in claim 10 wherein said interconnecting web extends to the bottom of said uppermost refractory section.

14. A coke oven door for sealing a coke oven as defined in claim 10 wherein said first downwardly depending leg portion has a bottom wall, said second downwardly depending leg portion is shorter than said first downwardly depending leg portion, and a leg segment is provided extending from said second downwardly depending leg portion to the level of the bottom of said uppermost refractory section.

* * * * *